United States Patent [19]

Esaki et al.

[11] Patent Number: 4,749,603

[45] Date of Patent: Jun. 7, 1988

[54] KNITTED FABRICS AND PROCESS FOR MANUFACTURING THE SAME

[75] Inventors: Tamemaru Esaki, Kyoto; Katsumasa Hata, Nishinomiya, both of Japan

[73] Assignee: Kuraray Co., Ltd., Kurashiki, Japan

[21] Appl. No.: 44,211

[22] Filed: Apr. 30, 1987

[51] Int. Cl.[4] ..... B32B 7/00

[52] U.S. Cl. ..... 428/91; 427/393.4; 428/95; 428/96; 428/97; 428/253; 428/254

[58] Field of Search ..... 428/91, 95, 96, 97, 428/253, 254; 427/393.4

[56] References Cited

U.S. PATENT DOCUMENTS 4,666,764 5/1987 Kobayashi et al. ..... 428/254

*Primary Examiner*—Marion C. McCamish

*Attorney, Agent, or Firm*—Oblon, Fisher, Spivak, McClelland & Maier

[57] ABSTRACT

Knitted fabrics in which at least yarns therein are composed mainly of polyester spun yarns made from staple fiber having an intrinsic viscosity of 0.36 dl/g or lower and subjected to hydrophilic finishing, whose weight is in the range from 120 to 460 g/m$^2$, whose lateral stretchability is 100% or larger, whose contact coldness is $1.2\times10^{-2}$ cal/cm$^2$/sec or lower, whose warmth retention ratio for unit thickness of 105 or higher, and whose wicking rate measured by the water dropping test is less than one second are very suitable for underwear use because of the following characteristics:

(1) Favorable feel of warmth upon contact with the skin.

(2) Adaptable to the skin and easy to wear because of high stretchability.

(3) Sustained feel of warmth during wear.

(4) Rendered hydrophilic to minimize stuffy feeling during wear, said hydrophilic nature being durable to laundering and giving no feel of coldness.

(5) Little tendency of forming pills.

(6) Soft in hand and mild to the skin.

(7) Whiteness maintained over long periods, giving a feel of cleanliness, with little tendency of yellowing and discoloration.

(8) Little tendency of generating static charges which can cause disagreeable electrostatic shocks.

(9) Readily driable after laundering with little deformation.

11 Claims, 1 Drawing Sheet

KNITTED FABRICS AND PROCESS FOR MANUFACTURING THE SAME

BACKGROUND OF THE INVENTION

1. Field of the Invention

This invention relates to knitted fabrics with excellent warmth-keeping and water-absorbing characteristics, and to a process for manufacturing the same.

2. Description of the Prior Art

Autumn and winter underwear is principally made of cotton. Although wool, acrylic and polyester fibers have also been employed for this purpose, no product has yet been created which satisfies all the requirements such as hand, warmth retention, stretchability, stretch recovery, anti-pilling property, water absorption, ease of drying, dimensional stability after laundering, whiteness and its retention, and static charge dissipation, and is low in cost at the same time. Fabrics made of natural fiber are favorable in moisture absorption but is poor in dimensional stability, whiteness and other properties, while those made of synthetic fiber are insufficient in anti-pilling and moisture-absorbing characteristics though excellent in dimensional stability and ease of drying after laundering.

Use of knitted fabrics made of polyester fiber as sportswear and underwear has recently been proposed, for example, in Japanese Patent Kokai Nos. 60-94682 (May 27, 1985), 60-246873 (Dec. 6, 1985) and 61-28073 (Feb. 7, 1986). Any of these fabrics is too poor in anti-pilling property to be put to use as underwear which needs frequent laundering, and does not satisfy consumers' requirement also in terms of comfort in wear such as warmth retention, etc. For example, the woven and knitted fabrics described in Japanese Patent Kokai No. 61-28073 (Feb. 7, 1986) are composed of polyethylene terephthalate copolymer fiber containing 0.8 to 1.8 mol% of sulfo-isophthalic acid and rendered hydrophilic, and have a dual structure with a cover factor ratio (front face to back face) less than 0.8. Fabrics of this type form pills after several times of wear and laundering. The pills thus formed tend to attach to other textiles during laundering and to intertwine with pieces of fiber released from these textiles, degrading their utility value. This trouble is particularly marked when fabrics of different colors are laundered together. In addition, pilling adversely affects warmth-keeping characteristics as well as the feel to the skin, making the affected fabric unsuitable for use as underwear.

Thoroughgoing studies on the characteristics required of garments kept in direct contact with the skin, particularly underwear, have led us to confirm that the characteristics listed below are essential to the development of new garments, particularly for underwear, with excellent properties not to be found in conventional products. This invention was accomplished based on these findings.

(1) Favorable feel of warmth upon contact with the skin.
(2) High stretchability to ensure adaptability to the skin and ease of wear.
(3) Sustained feel of warmth during wear.
(4) Rendered hydrophilic to minimize stuffy feeling during wear, said hydrophilic characteristics being durable to laundering and giving no feel of coldness.
(5) Little tendency of forming pills.
(6) Soft in hand and mild to the skin.

(7) Whiteness maintained over long periods, giving a feel of cleanliness, with little tendency of yellowing and discoloration.
(8) Little tendency of generating static charges which can cause disagreeable electrostatic shocks upon putting on or taking off.
(9) Easy to dry after laundering with little deformation.

DETAILED DESCRIPTION OF THE INVENTION

Summary of the Invention

The first object of this invention is to provide knitted fabrics suitable for garments, particularly autumn and winter underwear, made of polyester fiber which has hitherto been considered unsuitable for underwear. The second object of this invention is to provide a process for manufacturing such knitted fabrics.

The first object of this invention can be achieved by a knitted fabric in which at least yarns are composed mainly of polyester spun yarns having an intrinsic viscosity of 0.36 dl/g or lower and subjected to hydrophilic finishing, whose weight is in the range from 120 to 460 g/m$^2$, whose lateral stretchability is 100% or higher, whose contact coolness is $1.2\times10^{-2}$ cal/cm$^2$/sec or lower, whose warmth retention ratio for unit thickness is 105 or higher, and whose wicking rate (water-absorbing characteristic) measured by the water dropping test is less than one second. The second object of this invention can be achieved by a process which comprises (1) making a knitted fabric from spun yarns composed mainly of phosphorus-containing polyester fiber whose phosphorus content is 0.5 to 1.5 mol% based on the total acid component, whose intrinsic viscosity is in the range from 0.38 to 0.45 dl/g, and whose content of acidic terminal groups is 80 $\mu$eq/g or higher; (2) treating the knitted fabric made above at a temperature of 100° C. or higher in the presence of water to reduce the intrinsic viscosity of said phosphorus-containing polyester to 0.36 dl/g or lower; and (3) applying a hydrophilic finishing agent durable to laundering to an add-on of at least 0.1 wt% based on the knitted fabric before, during or after the heat treatment, followed by drying.

DESCRIPTION OF THE PREFERRED EMBODIMENTS

Figure 1:
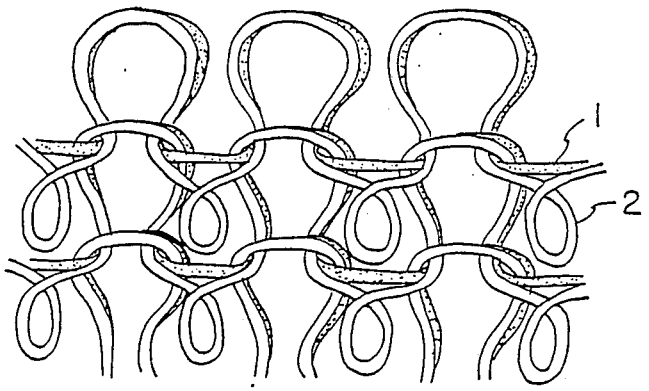
FIG. 1 illustrates the knitting structure of the fabric of Example 1 viewed from the pile face, in which numeral 1 is foundation yarn made of textured polyester filament yarns, and numeral 2 is pile yarn made of phosphorus-containing polyester spun yarns.

The knitted fabrics of this invention are made of spun yarns composed mainly of polyester staple fiber with excellent anti-pilling property as detailed later: The spun yarns may also contain a small amount of other staple fibers, such as cotton and wool, but are preferably composed totally of polyester fiber in terms of both cost and characteristics. Suitable knitting structures include pile fabric, sheeting, interlock fabric, circular rib fabric, eight-lock, reversible, fleecy fabric and quilting. Knitted fabrics of this invention may be best when it is pile structure. Such knitted fabrics are composed of spun yarns alone as described above, but the best combination to ensure high warmth retention and high stretchability is the use of textured polyester filament yarns as the foundation yarn and of polyester spun yarns as pile yarn. This combination provides a fabric having a relatively plain front face composed of textured polyester filament yarns and a soft, bulky and warmth-retaining back face composed of polyester spun yarns. It is preferable that the back face be further raised. The front face, although composed chiefly of filament yarns, shows soft and natural feel because part of the spun yarns in the back face surfaces in the form of pills.

In the knitted fabrics of this invention, the spun yarns used must be highly anti-pilling as otherwise heavy pilling would take place on the front face. Thus the polyester staple fiber constituting the knitted fabrics, particularly for underwear, of this invention must have an intrinsic viscosity of 0.36 dl/g or lower, preferably 0.35 dl/g or lower when measured in an equal-weight mixture of phenol and tetrachloroethane at 30° C. In actual practice, spun yarns are made of polyester having an intrinsic viscosity of, for example, 0.38 to 0.45 dl/g and containing a phosphorus compound as described later, a fabric is knitted by using, as pile yarn, the polyester spun yarns prepared above, and the fabric is treated at a temperature above 100° C., preferably at 120° to 140° C., for 10 to 90 minutes in the presence of water, thereby enhancing its anti-piling property. This heat treatment may preferably be performed after fiber producing or knitting process, because the fiber strength would be lowered during the process due to the reduction in the intrinsic viscosity and the lowered fiber strength would cause various troubles: single yarn and tow breakage and fiber fusion during cutting in the staple fiber manufacturing process; significant reduction in production speed and formation of weak and uneven yarns in the spinning process; and frequent formation of needle defects and broken yarns in the knitting process. Hence the heat treatment should best be performed in the dyeing step in the form of knitted fabrics. Since fabrics are generally subjected to wet processing at 100° to 140° C. in the dyeing process, reduction of intrinsic viscosity to 0.36 dl/g or lower can be achieved by proper selection of dyeing temperature and time, and hence this heat treatment does not add to the production cost. Use of the polyester staple fiber thus obtained gives highly anti-pilling property to underwear which is a kind of garment frequently laundered and which tends to form pills.

The phosporus-containing polyester fiber having such characteristics as described above may be produced as follows according to the method given in Japanese Patent Kokai No. 61-47818 (Mar. 8, 1986):

(1) A dicarboxylic acid component composed mainly of terephthalic acid, or a lower alkyl ester derivative thereof, is allowed to react with a glycol component composed mainly of ethylene glycol, or alkylene oxide composed mainly of ethylene oxide, to form the glycol ester of dicarboxylic acid composed mainly of terephthalic acid and/or oligomers thereof;

(2) the reaction product obtained in step (1) is then subjected to polycondensation reaction to form polyester whose recurring units contain at least 85% of ethylene terephthalate units, wherein an organic phosphorus compound of at least 96% purity, represented by the formula [I]

$$(C_nH_{2n+1}O)_2PO—OH \quad [I]$$

wherein n is an integer of 3 to 8, is added in a suitable stage before the polycondensation reaction is complete; and (3) the polyester obtained above is melt spun into phosphorus-containing polyester fiber having an intrinsic viscosity in the range from 0.38 to 0.45 dl/g and containing 80 μeq/g or higher of acidic termianl groups.

The organic phosphorus compounds of formula (1) have excellent polyester modifying effect and also possess the following characteristics: low degree of discoloration, little formation of ether bonding, less impurities formed in the polymerization system, low loss of phosphorus from the reaction system, and low cost. A phosphorus compound of this type is added to the polymerization system in such an amount that the content of phosphorus will be 0.5 to 1.5 mol% based on the total acid component. These are aliphatic or aromatic ester of phosphoric acid, of which di-n-butyl phosphate and di-n-octyl phosphate are most preferred. The phosphate molecules are incorporated into the polymer main chain during polymerization, and the phosphate linkages thus formed in the polyester chain readily undergo hydrolysis when heat-treated in the presence of water, thus serving to reduce the molecular weight of polyester and to exhibit anti-pilling effect. In this process, the presence of acidic terminal groups such as carboxyl groups accelerates the hydrolysis of phosphate linkages. For this reason, the polyester staple fiber used in this invention should preferably contain at least 80 μeq/g of acidic terminal groups. The alkyl group of the organic phosphorus compounds [I] should preferably have 3 to 8 carbon atoms. Phosphates of 1 to 2 carbon atoms lack in stability, while those of 9 or larger carbon atoms tend to discolor the resulting polyester. The purity of the phosphorus compounds should preferably be 96% or higher to prevent discoloration, formation of many ether linkages and other troubles. The mol % of phosphorus based on the total acid component is herein defined as the percentage of gram atoms of phosphorus contained in the polyester to the total mols of acid components used for the manufacture of polyester.

Polyester spun yarns used by this invention are obtained by spining the above fibers by the conventional methods. In this invention, it is important for such fibers to have a size of 0.5 to 2.5 deniers and a length of 30 to 80 mm.

In the knitted fabrics of this invention, ordinary textured polyester filament yarns may be suitably used in combination with the highly anti-pilling polyester staple fiber detailed above. These polyester filament yarns are made of polymer obtained by reaction of terephthalic acid or a lower alkyl ester thereof with a lower glycol, in which part of the acid component may be replaced with other dicarboxylic acid such as isophthalic acid, sodium salt of 5-sulfo-isophthalic acid, adipic acid and sebacic acid or a lowe alkyl ester thereof. The glycol component is chiefly ethylene glycol, which also may be partly or wholly replaced, as required, by other glycol such as propylene glycol, 1,4-butanediol, trimethylene glycol, 1,4-hexanediol and neopentyl glycol. The polyesster may also contain, as reqiured, additives such as titanium dioxide, silicon dioxide, alumina-related substances, tin oxide and carbon, and antioxidants, stabilizers, fluorescent brighteners and pigment. The polyester is melt-spun into filaments, which are then texturized by known techniques, for example, false twisting. The suitable size of textured polyester filament yarns used in this invention is 30 to 200 deniers, preferably, 40 to 100 deniers.

The fiber, particularly staple fiber, constituting a knitted fabric of this invention is rendered hydrophilic by treatment with a finishing agent durable to laundering. The durability should be such that the wicking rate (water-absorbing characteristic) measured by the water dropping method, is one second or less after 30 times of laundering. Typical examples of hydrophilic finishing agents showing such durability to laundering are low molecular-weight polyesters made from polyethylene glycol and terephthalic acid and having a structure represented by formula [II] below,

[II]

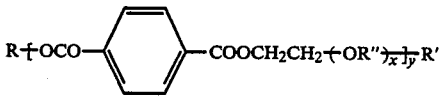

wherein R is hydrogen atom or an alkyl group of 1 to 12 carbon atoms; R' is hydrogen atom, hydroxyl group or an alkoxy group of 1 to 12 carbon atoms; R'' is an alkylene group of 3 to 5 carbon atoms; x is an integer of 1 to 20; and y is an integer of 5 to 50. These are commercially available under the tradenames of SR100 (Takamatsu Oils & Fats Co., Ltd.) and Permalose T (I.C.I.).

These finishing agents should be applied to such an add-on that the water-absorbing ability of finished fabric will be less than one second when measured by the water dropping method or 90 mm or larger when measured by the Byreck method. If applied under conditions other than the above, these agents may cause various troubles; stuffy feeling during wear when applied to underwear, build-up of electric charges, and others. The suitable add-on to ensure satisfactory effects may vary depending on the type of finishing agent, and is in the range from about 0.1 to about 2%, most preferably, from 0.2 to 1% with SR1000 (Takamatsu Oils & Fats). The knitted fabric applied with such a finishing agent is then dried and heat-treated (dry or wet) preferably at a temperature of 60° to 160° C. for fixation of the agent to the fiber. Fixation is insufficient at lower treating temperatures, while discoloration is likely to occur at higher temperatures.

In order for a knitted fabric to be used as underwear, it should preferably feel warm upon contact with the skin and hands. This property can be evaluated as contact coolness, which is herein defined as the quantity of heat (cal/cm$^2$/sec) instantaneously absorbed by a sample of knitted fabric held at 20° C. when a copper plate held at 30° C. is brought into contact with that knitted fabric. This contact coolness, which is determined by the surface characteristics of the material under consideration, is considered to depend on the knitting structure and to be changed by surface modification. We have succeeded in creating warmth by proper combination of these factors. It was demonstrated that the knitted fabrics of this invention should have a contact coolness value of $1.2\times10^{-2}$ (cal/cm$^2$/sec) or less, most preferably, $1.1\times10^{-2}$ or less in order to feel warm upon contact with the skin. Of various natural fibers, only wool satisfies this condition, with cotton and ordinary textured polyester filament yarns showing higher values. Spun yarns composed mainly of polyester subjected to hydrophilic finishing must be used to satisfy the requirement specified above.

However, underwear cannot keep warmth sufficiently without having a high warmth retention ratio even with a low contact coldness value. Such warmth-keeping property can be expressed in terms of "warmth retention ratio", and this is herein defined as a ratio of the quantity of heat needed to maintain knitted fabrics at 33° C. (temperature of skin) when it is cooled by blowing air (20° C., 50% R.H.) at a speed of 0.1 m/sec to the corresponding value for 3-ply cotton interlock fabric taken as 100. For this purpose of this invention, this value should be 105 or higher, most preferably, 110 or higher. In order to satisfy this requirement, underwear must have a special knitting structure to include immobile air inside. A typical example is shown in FIG. 1, in which looped or raised spun yarns are used on one face, thus securing immobile air mass in the loops.

The knitted fabrics of this invention should be designed so as to give a lateral stretchability of 100% or higher, as otherwise one may feel hard and tight during wear and when putting it on or taking it off.

It is preferable that the weight of knitted fabrics of this invention be in the range from 120 to 460 g/m$^2$ in terms of both performance and economy.

Characteristics of underwears and shirts made from knitted fabrics thus obtained may be summerized as follows:

because of the low contact coolness of $1.2\times10^{-2}$ (cal/cm$^2$/sec) or lower.

(2) Feel of warmth during wear sustained over long periods thanks to the warmth retention ratio of 105 or higher.

(3) Adaptable to the skin and easy to wear because of the lateral stretchability of 100% or higher, allowing free movement with no resistance.

(4) Minimized stuffy feeling even in a sweat because of the high water absorption, and less sticky and cold feel, as observed with cotton underwear, even when wet with perspiration thanks to the quick-drying property. These characteristics are durable against repeated laundering.

(5) Highly anti-pilling, with substantially no pill formation during wear.

(6) Soft in hand and mild to the skin.

(7) Whiteness maintained over long periods, with little tendency of yellowing as observed with natural fibers.

(8) Little tendency of generating static charges which can cause disagreeable electrostatic shocks.

(9) Readily dryable after laundering with little deformation.

When compared with cotton and wool, the knitted fabrics of this invention are far better than cotton and comparable to wool in warmth keeping ability, and are far inexpensive and easier to handle than wool. Much is expected of such knitted fabrics of this invention as an essential material for autumn and winter underwear. Other potential applications would be in the fields of T-shirts, knitted sportswear, training pants, towels, nightshirts, socks and stockings.

The following Examples will further illustrate the invention but are not intended to limit its scope. The values used in the Examples are those measured according to the methods enumerated below.

(1) Intrinsic viscosity—Measured in an equal-weight mixture of phenol and tetrachloroethane at 30° C. (unit: dl/g)

(2) Concentration of acidic terminal groups—A sample is dissolved in benzyl alcohol and diluted chloroform, and the solution is titrated with caustic soda using Phenol Red as indicator (unit: μeq/g).

(3) Contact coolness—A sample is supported on a plate held at 20° C., a copper plate held at 30° C. is put on the sample, and the quantity of heat (q) instantaneously absorbed by the sample is measured (unit: cal/cm²/sec).

(4) Warmth retention ratio—A sample is cooled by blowing air (20° C., 50% R.H.) at a speed of 0.1 m/sec, and the quantity of heat needed to maintain it at 33° C. (skin temperature) under this condition is measured (expressed as ratio to the corresponding value for 3-ply cotton interlock fabric is taken as 100). In actual practice, the required quantity of heat is measured electrically and expressed in watts per 100 cm² of fabric, and the warmth retaining capacity of a 3-ply cotton interlock fabric having a value of 1,302 watts is taken as 100.

(5) Pilling—JIS*L-1076-1935

*Japanese Industrial Standard (6) Stretchability—JIS L-1018-1977

(7) Water absorption—JIS L-1018-1977

(8) Drying speed—JIS L-1018-1977

(9) Laundering durability—JIS L-0217-1976

(10) Lightfastness

EXAMPLE 1

Dimethyl terephthalate (990 parts by weight), ethylene glycol (790 parts) and zinc acetate (0.2 part) were changed in a reactor equipped with a fractionator, and the mixture was heated with agitation to 160° to 230° C. for 3.5 hours while distilling off liberated methanol to effect ester exchange. The product was transferred to a polymerization reactor, after which di-n-butyl phosphate of 97% purity (10.7 parts) and antimony trioxide (0.4 part) were added, and the mixture was polymerized at 280° C. for 2.5 hours under a reduced pressure of 0.5 mmHg, giving polyester chips having an intrinsic viscosity of 0.52 dl/g and containing 1 mol % phosphorus and 3 mol% diethylene glycol linkage. The chips were melt-spun, drawn and heat-treated, giving staple fiber (1.5×38 mm) having an intrinsic viscosity of 0.42 dl/g and containing 100 μeq/g of acidic terminal groups. Polyester spun yarns of 40/1 cotton count were made from this staple fiber.

Using textured polyester filament yarns (75d/36f), separately obtained by a usual method, as foundation yarn and the polyester spun yarns obtained above as pile yarn, a fabric weighing 190 g/m² as shown in FIG. 1 was knitted on a circular knitting machine (24-gauge, 30-inch). This knitted fabric was treated with a flueorescent brightener, and then with hydrophilic finishing agent, SR1000, to an add-on of 0.5 weight % and its back face was slightly raised after drying. The characteristics of the finished knit fabric thus obtained are summarized in Table 1. The intrinsic viscosity of spun yarns unknitted from the finished fabric was 0.32 dl/g. There was no trouble at all throughout the whole course of processing.

COMPARATIVE EXAMPLES 1 THROUGH 3

Knitted fabrics were manufactured in much the same manner as in Example 1, except that merino wood ($W^1/64$), polyacrylnitrile fiber ($W^1/64$) or cotton combed yarns ($^c40/1$) were used in place of the phosphorus-containing polyester spun yarns of the Example 1. The knitted fabrics thus obtained were each treated in the dyehouse under appropriate conditions, with no finishing agent being applied. The data for these fabrics are also shown in Table 1, indicating overall superiority of the knitted fabric of this invention (Example 1) over the other fabrics.

COMPARATIVE EXAMPLE 4

A knitted fabric was manufactured in much the same manner as in Example 1, except that the amount of di-n-butyl phosphate was changed to 0.6 part by weight. The intrinsic viscosity of staple fiber before knitting was 0.45 dl/g, while the value of unknitted spun yarns after fnishing was 0.39 dl/g.

Evaluation of the finished fabric in the same way as in Example 1 revealed that it is comparable to the fabric of Example 1 in warmth retention, stretchability, water absorption, dryability, durability to laundering and lightfastness, but cannot be put to practical use because of the poor anti-pilling property (rating 1 to 2) as shown in Table 2.

TABLE 1

| | Example 1 | Comp. Ex. 1 (100% Wool) | Comp. Ex. 2 (100% PAN) | Comp. Ex. 3 (100% Cotton) | Remarks |
|---|---|---|---|---|---|
| Warmth-keeping characteristics: | | | | | |
| Contact coolness, × $10^{-2}$(cal/cm²/sec) | 1.05 | 1.08 | 1.27 | 2.41 | Ratio to 3-ply cotton |
| Warmth retention ratio | 113 | 109 | 121 | 109 | interlock fabric (100) |
| Lateral stretchability (%) | 149 | 150 | 148 | 55 | JIS L1018-1977 (constant load method) |
| Pilling (rating) | | | | | |
| Before laundering | 5 | 4.5 | 1 | 2.5 | JIS L1076-1935; |
| After 30 launderings | 5 | 2 | 1 | 2.5 | Measured on front face |
| Water-absorbing characteristics (Before laundering) | | | | | |
| Water dropping method (sec) | <1.0 | >180 | >180 | 1.0 | JIS L1018-1977; |
| Byreck method (mm; lengthwise/lateral) | 159/149 | 0/0 | 0/0 | 42/43 | Measured on back face |
| (After 30 launderings) | | | | | |
| Water dropping method (sec) | <1.0 | 154 | <1.0 | <1.0 | |
| Byreck method (mm; lengthwise/lateral) | 139/129 | 0/0 | 143/128 | 111/92 | |
| Drying speed (hours needed for water absorption to fall below 1.0%) | 2 | 5 | 2 | 4 | JIS L1018-1977 |
| Deformation after laundering (%; lengthwise/lateral) | 2.3/0.1 | −3.4/10.4 | −2.3/0.2 | 2.7/11.4 | JIS L0217-1976; Hang drying |
| Lightfastness (rating) | 4 | >3 | >3 | >3 | JIS L0842-1971 |

COMPARATIVE EXAMPLE 5

A knitted fabric was manufactured in much the same maner as in Example 1, except that polyester spun yarns ($^c40/1$) made of 1.5d×38 mm staple fiber (initial intrinsic viscosity: 0.52 dl/g; acidic terminal groups: 35 μeq/g) were used in place of the phosphorus-containing polyester spun yarns. As shown in Table 2, the finished fabric thus obtained was too poor in anti-pilling property (rating 1) to be put to practical use. The intrinsic viscosity of unknitted spun yarns was 0.51 dl/g.

TABLE 2

| | Example 1 | Comparative Example 4 | Comparative Example 5 |
|---|---|---|---|
| [η] of polyester staple fiber before knitting | 0.42 | 0.45 | 0.52 |
| [η] of polyester staple fiber in finished fabric | 0.33 | 0.39 | 0.51 |
| Pilling (rating) | 5 | 1–2 | 1 |

COMPARATIVE EXAMPLE 6

A fabric was manufactured through knitting, hydrophilic finishing and heat treatment in much the same manner as in Example 1, except that polyester spun yarns ($^{c}40/1$), made of staple fiber (1.5d×38 mm) which was obtained from polyethylene terephthalate copolymer containing 1.5 mol% sulfo-isophthalic acid, were used in place of the spun yarns made of phosphorus-containing polyester. Evaluation of the finished fabric thus obtained in the same way as in Example 1 revealed that it is comparable to the fabric of Example 1 in warmth retention, stretchability, water absorption, dryability and durability to laundering, but cannot be put to practical use because of the poor anti-pilling property (rating 2).

EXAMPLES 2 TO 3 AND COMPARATIVE EXAMPLES 7 THROUGH 10

Underwears were manufactured by using knitted fabrics A through F as shown below and subjected to an actual wear test by 50 panelists. Each panelist was allowed to wear the six underwears at random to make evaluation for several items, and the result was arranged so that the total score for each item will be 100% (Table 3).

Knit fabric A

The fabric obtained in Example 1.

Knit fabric B

The polyester staple fiber obtained in Example 1 was blended with cotton at a weight ratio of 10/90, and spun yarns ($^{c}40/1$) were made from this blend fiber. Fabric B was manufactured in much the same manner as in Example 1 (knitting, hydrophilic finishing, heat treatment and raising of back face), except that the spun yarns of blended fiber obtained above were used as pile yarn.

Knit fabrics C and D

Fabrics made in much the same manner as for fabric B, except that the polyester/cotton blend ratio was changed to 50/50 and 30/70, respectively.

Knit fabric E

A grey-sheeting knit fabric was made by using the spun yarns employed in Example 1 on a 28-gauge/30-inch knitting machine in place of the 24-gauge/30-inch circular knitting machine. Fabric E (weight: 105 g/m²) was manufactured by finishing the fabric knitted above in the same manner as for knitted fabric B.

Knit fabric F

Fabric manufactured in much the same manner as in Example 1, except that no hydrophilic finishing was applied.

TABLE 3

| Knit fabric | Example 2 A | Example 3 B | Comp. Ex. 7 C | Comp. Ex. 8 D | Comp. Ex. 9 E | Comp. Ex. 10 F |
|---|---|---|---|---|---|---|
| Pile yarns used | Yarns used in Ex. 1 | Blend of staple fiber used in Ex. 1 with cotton | | | Yarns used in Ex. 1 | |
| | | 90/10 | 50/50 | 30/70 | | |
| Fabric structure | | pile | | | Sheeting | pile |
| Hydrophilic finishing | | | Yes | | | No |
| Warmth-keeping characteristics: | | | | | | |
| Contact coldness × $10^{-2}$(cal/cm²/sec) | 1.05 | 1.20 | 1.88 | 2.01 | 1.10 | 1.04 |
| Warmth-retention ratio | 113 | 111 | 105 | 102 | 98 | 115 |
| Organoleptic test (actual wear): | | | | | | |
| (Feel at cloth changing) | | | | | | |
| Very warm | 96 | 84 | 20 | 8 | 84 | 96 |
| Warm | 4 | 10 | 48 | 32 | 16 | 4 |
| Cold | 0 | 6 | 32 | 60 | 0 | 0 |
| (Total: 100%) | | | | | | |
| (Touch during wear) | | | | | | |
| Soft | 98 | 88 | 44 | 32 | 72 | 96 |
| Moderate | 2 | 10 | 36 | 48 | 28 | 4 |
| Stiff | 0 | 2 | 20 | 20 | 0 | 0 |
| (Total: 100%) | | | | | | |
| (Stuffiness during wear) | | | | | | |
| Not stuffy | 96 | 94 | 80 | 72 | 80 | 40 |
| Stuffy | 4 | 6 | 20 | 28 | 20 | 60 |
| (Total: 100%) | | | | | | |
| (Overall evaluation) | | | | | | |
| Excellent | 100 | 92 | 24 | 20 | 52 | 70 |
| Good | 0 | 6 | 40 | 36 | 20 | 20 |
| Fair | 0 | 2 | 36 | 44 | 28 | 10 |
| (Total: 100%) | | | | | | |

What is claimed is:

1. Knitted fabrics in which at least yarns therein are composed mainly of polyester spun yarns made from staple fiber having an intrinsic viscosity of 0.36 dl/g or lower and subjected to hydrophilic finishing, said knitted fabrics having a weight in the range from 120 to 460 g/m², a lateral stretchability of 100% or larger, a contact coldness of $1.2\times10^{-2}$ cal/cm²/sec or lower, a warmth retention ratio for unit thickness of 105 or higher, and a wicking rate measured by the water dropping test of less than one second.

2. The knitted fabrics as defined in claim 1, wherein said polyester staple fiber is phosphorus-containing polyester whose phosphorus content is 0.5 to 1.5 mol% based on the total acid components, whose intrinsic viscosity is 0.36 dl/g or lower, and whose content of acidic terminal groups is 80 μeq/g or higher.

3. The knitted fabrics as defined in claim 1 or 2 having a pile structure on at least one face thereof.

4. The knitted fabrics as defined in any one of claims 1 through 3, wherein one knit face is composed of said polyester spun yarns and the other knit face is composed of textured polyester filament yarns.

5. The knitted fabrics as defined in any one of claims 1 through 4, wherein the knit face has been raised.

6. Garments made of a knitted fabrics in which at least yarns therein are composed mainly of polyester spun yarns made from staple fiber having an intrinsic viscosity of 0.36 dl/g or lower and subjected to hydrophilic finishing, said knitted fabrics having a weight in the range from 120 to 460 g/m$^2$, a lateral stretchability of 100% or larger, a contact coldness of $1.2\times10^{-2}$ cal/cm$^2$/sec or lower, a warmth retention ratio for unit thickness of 105 or higher, and a wicking rate measured by the water dropping test of less than one second.

7. Garments as defined in claim 6 to be used as underwear.

8. A process for manufacturing knitted fabrics which comprises (1) making a knit fabric from spun yarns composed mainly of phosphorus-containing polyester spun yarns whose phosphorus content is 0.5 to 1.5 mol% based on the total acid components, whose intrinsic viscosity is in the range from 0.38 to 0.45 dl/g, and whose content of acidic terminal groups is 80 μeq/g or higher; (2) treating the knitted fabric prepared above at a temperature of 100° C. or higher in the presence of water to reduce the intrinsic viscosity of said phosphorus-containing polyester to 0.36 dl/g or lower; and (3) applying a hydrophilic finishing agent durable to laundering to an add-on of at least 0.1 weight % based on the knitted fabric before, during or after the heat treatment, followed by drying.

9. The process for manufacturing knitted fabrics as defined in claim 8, wherein said phosphorus-containing polyester staple fiber is obtained by steps comprising:

(1) reacting a dicarboxylic acid component composed mainly of terephthalic acid, or a lower alkyl ester derivative thereof, with a glycol component composed mainly of ethylene glycol, or alkylene oxide composed mainly of ethylene oxide, to form the glycol ester of dicarboxylic acid composed mainly of terephthalic acid and/or oligomers thereof, (2) subjecting the reaction product obtained in step (1) to polycondensation reaction to form polyester whose recurring units contain at least 85% of ethylene terephthalate units, and adding an organic phosphorus compound of at least 96% purity at a suitable stage before the polycondensation reaction is complete, and (3) melt-spinning the polyester obtained above into phosphorus-containing polyester fiber having an intrinsic viscosity in the range from 0.38 to 0.45 dl/g and containing 80 μeq/g or higher of acidic termianl groups, and heat-treating the polyester fiber thus obtained at a temperature of 110° C. or higher to reduce the intrinsic viscosity to 0.36 dl/g or lower.

10. The process for manufacturing knitted fabrics as defined in claim 8 or 9, wherein said organic phosphorus compound is a dialkyl phosphate represented by the following general formula:

$$(C_nH_{2n+1}O)_2PO—OH$$

wherein n is an integer of 3 to 8.

11. The process for manufacturing knitted fabrics as defined in claim 9 or 10, wherein said hydrophilic finishing agent is a low molecular-weight polyester of polyethylene glycol and terephthalic acid.

* * * * *

UNITED STATES PATENT AND TRADEMARK OFFICE

CERTIFICATE OF CORRECTION

PATENT NO. : 4,749,603

DATED : Jun. 7, 1988

INVENTOR(S) : Tamemaru ESAKI, et al.

It is certified that error appears in the above-identified patent and that said Letters Patent is hereby corrected as shown below:

The following Foreign Application Priority Data should be included:

-- May 8, 1986 [JP] Japan ..... 61-106238 --

Signed and Sealed this

Twentieth Day of September, 1988

*Attest:*

DONALD J. QUIGG

*Attesting Officer*

*Commissioner of Patents and Trademarks*